US009560434B2

(12) United States Patent
Schermerhorn

(10) Patent No.: US 9,560,434 B2
(45) Date of Patent: Jan. 31, 2017

(54) HEAD CORD AUDIO SYSTEM AND METHOD OF USE THEREOF

(71) Applicant: Jeffrey Wade Schermerhorn, Murrayville, GA (US)

(72) Inventor: Jeffrey Wade Schermerhorn, Murrayville, GA (US)

(73) Assignee: Jeffrey W. Schermerhorn, Murrayville, GA (US)

( * ) Notice: Subject to any disclaimer, the term of this patent is extended or adjusted under 35 U.S.C. 154(b) by 0 days.

(21) Appl. No.: 14/745,896

(22) Filed: Jun. 22, 2015

(65) Prior Publication Data

US 2015/0289048 A1 Oct. 8, 2015

Related U.S. Application Data

(63) Continuation-in-part of application No. 14/606,402, filed on Jan. 27, 2015, which is a continuation-in-part of application No. 14/069,706, filed on Nov. 1, 2013, now Pat. No. 9,144,260, which is a continuation-in-part of application No. 13/803,714, filed on Mar. 14, 2013, now abandoned.

(51) Int. Cl.

| | |
|---|---|
| ***H04R 1/10*** | (2006.01) |
| ***A63B 71/06*** | (2006.01) |
| ***A63B 33/00*** | (2006.01) |
| *A42B 1/12* | (2006.01) |
| *A42B 1/24* | (2006.01) |

(52) U.S. Cl.

CPC ..... *H04R 1/1033* (2013.01); *A63B 33/00* (2013.01); *A63B 33/002* (2013.01); *A63B 71/0622* (2013.01); *H04R 1/1091* (2013.01); *A42B 1/12* (2013.01); *A42B 1/245* (2013.01); *H04R 2201/023* (2013.01)

(58) Field of Classification Search

CPC ..... A42B 1/00; A42B 1/12; A42B 1/24

USPC ..... 128/866; 379/391; 381/17, 71, 71.6, 92, 381/93, 312, 313, 315, 317, 325, 328, 381/355, 370, 74, 79, 87, 301, 309, 333, 381/375, 376, 380, 384, 388; 455/569.1; 704/227; 2/68, 181, 2/209.13, 426; 104/88.04; 345/8

See application file for complete search history.

(56) References Cited

U.S. PATENT DOCUMENTS

| | | | | |
|---|---|---|---|---|
| 5,617,477 A * | 4/1997 | Boyden | H04R 3/12 | 381/309 |
| 5,706,735 A * | 1/1998 | Lund | B61B 13/00 | 104/130.07 |
| 6,208,740 B1 * | 3/2001 | Grever | H04B 5/0006 | 381/79 |
| 6,233,345 B1 * | 5/2001 | Urwyler | H04R 1/1033 | 351/123 |
| 6,301,367 B1 * | 10/2001 | Boyden | A42B 1/245 | 2/209 |
| 7,974,432 B1 * | 7/2011 | Ryan | A42B 1/245 | 2/195.1 |

(Continued)

*Primary Examiner* — Gerald Gauthier

(74) *Attorney, Agent, or Firm* — Grell & Watson Patent Attorneys, LLC

(57) ABSTRACT

A head gear audio system having an audio plug electrically connected to a y-adapter, a left coiled wire having a first end and a second end, the first end connected to the y-adapter and the second end connected to a left ear bud speaker; and a right coiled wire having a first end and a second end, the first end connected to the y-adapter and the second end connected to a right ear bud speaker, wherein the left coiled wire is releasably affixed to a left section of a stretchable cord and the right coiled wire is releasably affixed to a right section of the stretchable cord, and a tensioner.

14 Claims, 19 Drawing Sheets

(56) References Cited

U.S. PATENT DOCUMENTS 9,144,260 B2 * 9/2015 Schermerhorn ..... A42B 1/12
2001/0010727 A1 * 8/2001 Urwyler ..... H04R 1/1033 381/384
2004/0008157 A1 * 1/2004 Brubaker ..... G02B 27/0176 345/8
2006/0185062 A1 * 8/2006 Peng ..... H04R 5/0335 2/209.13
2008/0144872 A1 * 6/2008 Phillips ..... H04R 5/0335 381/333
2008/0181429 A1 * 7/2008 Fried ..... A42B 1/245 381/87
2009/0175482 A1 * 7/2009 Crutcher ..... A42B 1/245 381/376
2009/0208040 A1 * 8/2009 Planansky ..... H04R 5/02 381/301
2011/0286620 A1 * 11/2011 Flynn ..... A42B 1/245 381/375
2012/0087532 A1 * 4/2012 Yang ..... H04R 1/10 381/380
2012/0328119 A1 * 12/2012 Heise ..... H04R 1/1066 381/74
2013/0028437 A1 * 1/2013 Bruss ..... H04R 1/1008 381/74
2013/0160187 A1 * 6/2013 Crutcher ..... A42B 1/245 2/181
2014/0064510 A1 * 3/2014 Grinnip, III ..... C08B 37/0072 381/74
2014/0140568 A1 * 5/2014 Im ..... H04R 1/1033 381/384
2014/0146979 A1 * 5/2014 Puskarich ..... H04R 5/033 381/74
2014/0259264 A1 * 9/2014 Schermerhorn ..... A42B 1/12 2/68
2015/0289048 A1 * 10/2015 Schermerhorn ... A63B 71/0622 381/376
2015/0326964 A1 * 11/2015 Zheng ..... H05B 33/08 381/74

* cited by examiner

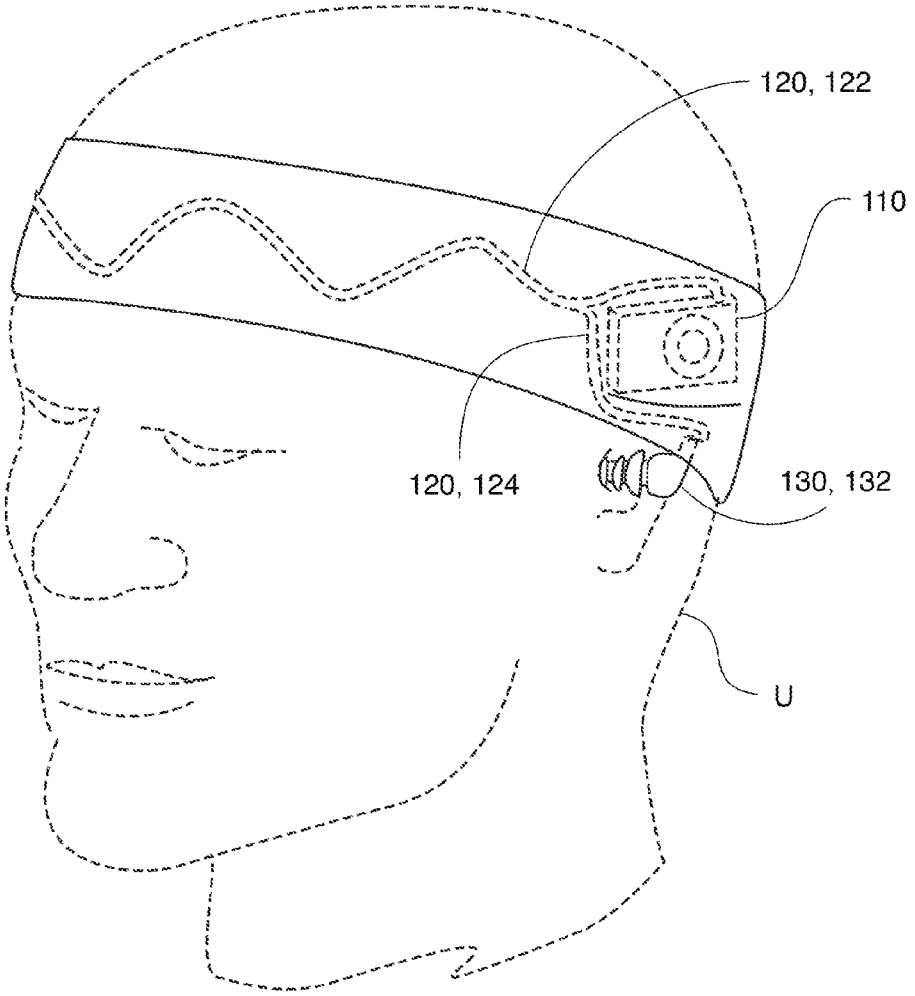
FIG. 6.1

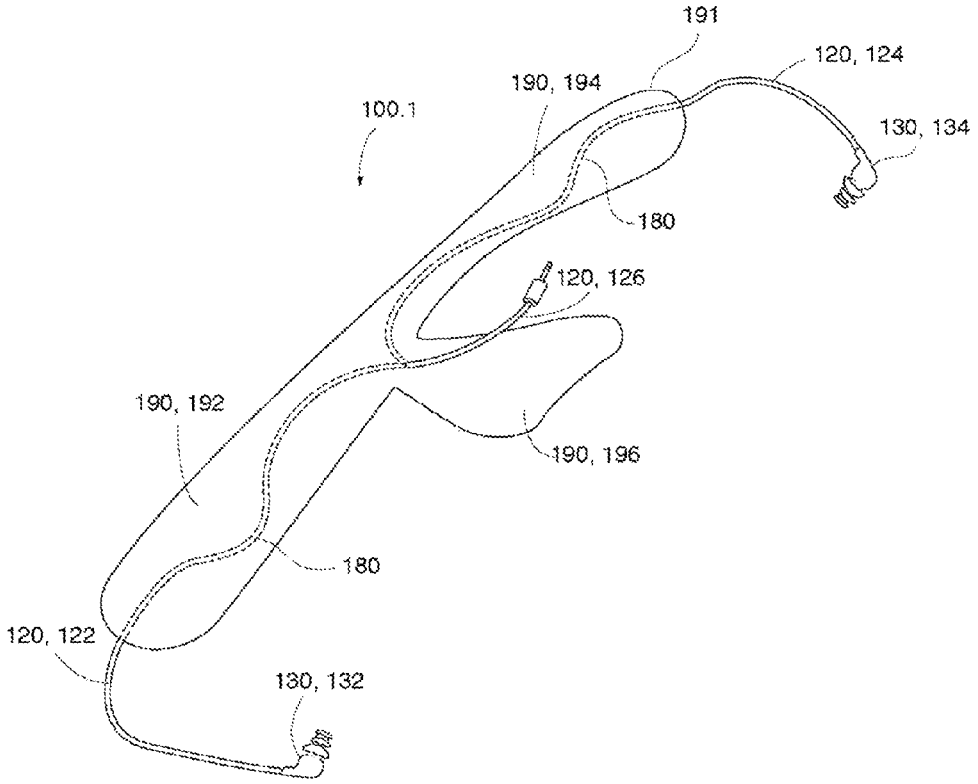
FIG. 6.2

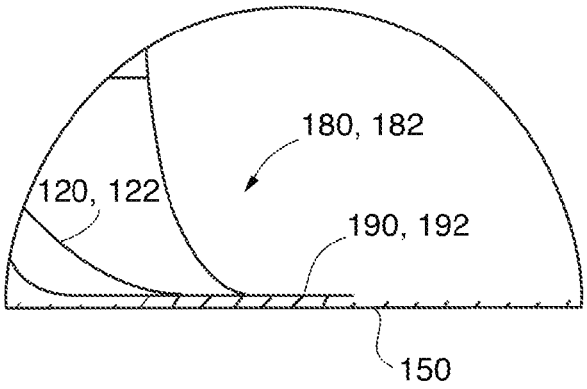
FIG. 9A
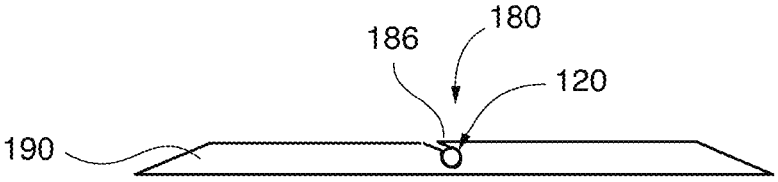
FIG. 9B1
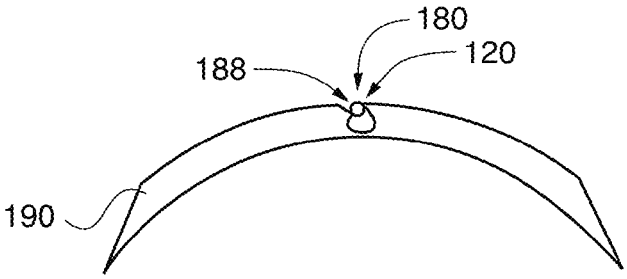
FIG. 9B2

HEAD CORD AUDIO SYSTEM AND METHOD OF USE THEREOF

CROSS-REFERENCE TO RELATED APPLICATIONS

To the full extent permitted by law, the present United States Non-provisional Patent Application, is a Continuation-in-Part of, and hereby claims priority to and the full benefit of U.S. Non-provisional application entitled "Swim Goggle Audio System and Method of Use Thereof," having assigned Ser. No. 14/606,402, filed on Jan. 27, 2015, which is a Continuation-in-Part of U.S. Non-provisional application entitled "Swim Cap and Method of Use Thereof," having assigned Ser. No. 14/069,706, filed on Nov. 1, 2013, which is a Continuation-in-Part of U.S. Non-provisional application entitled "Swim Cap and Method of Use Thereof," having assigned Ser. No. 13/803,714, filed on Mar. 14, 2013, incorporated herein by reference in their entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

Technical Field of the Invention

The disclosure generally relates to headgear and a method of using the same, and more specifically to headgear with an audio player and headphones.

Description of Related Art

The disclosure relates generally to headgear with a music player and headphones and a method of using the same.

One previous approach was to use a water proof headphone system that could be secured to swimming goggles, wherein the MPS player was placed around the back of the swimmer's head. A problem with this approach is that the system might be uncomfortable located on the back of a head, create additional drag, and the system moving could compromise the goggles' watertight seal.

Another approach was to use a swim cap with a speaker and a radio antenna. One problem with this approach is that the battery needed to maintain a radio connection could be prohibitively large. Another problem is that the radio connection might be compromised by interference from the water. Yet another problem is that the individual swimmer did not have any input on what sound was transmitted.

Another approach is to tie a water proof ear bud audio system to goggle straps. A problem with this approach is that the audio wires create drag in the water, become tangled in the goggle straps, and become unorganized and difficult to untangle between use and storage.

Therefore, it is readily apparent that there is a recognizable unmet need for a swim goggle audio system that is easy to produce, tolerant of the movement inherent in swimming, capable of being stretched without compromising any aspect of functionality, and very easy to use.

SUMMARY

Briefly described, in a preferred embodiment, the present apparatus and method overcomes the above-mentioned disadvantages and meets the recognized need for such a device by providing a head gear audio system, wherein the head gear audio system includes a cord, the cord having a first cord end and a second cord end, an audio plug electrically connected to one end of a third wire, a y-junction electrically connected to an other end of the third wire and the y-junction electrically connected to one end of a first wire and one end of a second wire, a pair of earphones, the pair of earphones having a first earphone electrically connected to an other end of the first wire and a second earphone electrically connected to an other end of the second wire, wherein each of the first wire and the second wire are configured having a first coiled wire section positioned between the y-junction and the first earphone and a second coiled wire section positioned between the y-junction and the second earphone, and wherein the first cord end is positioned therethrough the first coiled wire section and the second cord end is positioned therethrough the second coiled wire section.

The present apparatus and method overcomes the above-mentioned disadvantages and meets the recognized need for such a device by providing a swim cap capable of integrating headphones that is easy to produce, tolerant of the movement inherent in swimming, capable of being stretched without compromising any aspect of functionality of the headphones, and very easy to use.

The present apparatus and method includes a swim cap device having a groove and a pocket configured therein capable of accommodating a player, wires, and earphones. The wires are disposed in serpentine grooves when the swim cap is in a non-stretched position, and the wires connect the player to the user's ears.

According to its major aspects and broadly stated, the present disclosure describes a headgear device, the headgear device having a pocket and a groove configured therein, to accommodate a player, earphones, and a wire, the wire being connected to the player, and the wire being in a serpentine disposition when the headgear device is not in a stretched position.

In an embodiment, a headgear device comprises a cover with a groove to accommodate a wire, the wire being connected to the player, and the wire being in the groove in a serpentine disposition when the cover is not in a stretched position.

More specifically, the present disclosure of a preferred embodiment is a swim cap; the swim cap comprises a cover with pocket configured to accommodate a player, and a groove to accommodate wires of earphones. The wires have a first wire and a second wire. The earphones have a first earphone and a second earphone. The first wire may be positioned in a first groove in a serpentine disposition and the second wire may be positioned in a second groove in a serpentine disposition. In one embodiment, the cover includes a first layer and a strip for providing the groove on the first layer. In another embodiment, the cover includes a first layer and a first strip and a second strip for providing the first and second grooves, respectively, on the first layer.

In use, the wires are preferably positioned in the groove or grooves in a serpentine disposition when the swim cap is in a non-stretched position. This serpentine disposition of the wires allows the swim cap to be stretched without compromising the functionality of the wires, or negatively affecting either how the wires attach to the player, or how the earphones reach to the user's ears. The wires may be embedded within an elastic conduit within the groove or grooves.

In an embodiment, a player pocket may be disposed within the first layer, and when the player is placed within the player pocket, the swim cap will thus secure the player. Alternatively, the player pocket may expose a pouch that will secure the player while it is inside the opening. Also, the cover may include a single layer, with the groove and wires being disposed and molded within the cover. Or, the player pocket may be disposed inside the swim cap. In one embodiment, the player pocket may include a wire jack access hole for connecting the wire to the player.

In this embodiment, a wire split pocket may be included in the cover between the player pocket and groove. The wire split pocket may be for housing the wire where it splits off into the first and second wires before the first and second grooves.

In use, a user obtains a swim cap, and then secures the player to the swim cap and attached to a headphone plug. The player may be started, and optionally secured inside the swim cap. To secure the player inside the swim cap, the wires may be first inserted into the groove or grooves or positioned therein, and, if provided, through the wire split pocket. This may be done by bending the cover thereby reducing the overhang of the groove or grooves and providing an opening into the groove or grooves. Then the wires may be connected to the player, like through the wire jacket access hole. Finally, the player may be positioned in the player pocket. The swim cap is then placed on the user's head, and the earphones are placed in the user's ears.

The cover may include at least two layers, a first layer and a second layer, the wire being disposed between the layers. There may be an opening in the outside layer, or in the inside layer, or in both, the opening may be used to place a player and secure it therein the swim cap.

Alternatively, the swim cap cover may be a single layer, with the wire being disposed within the single layer.

Still further the swim cap may include one or more passageways wherein the wire may be disposed or run within the single layer or at least two layers.

In use, a swim cap is obtained, and then placed on the user's head. The earphones are placed in the user's ears, and the player is started. However, it is contemplated herein that the steps executed may be executed in any order and need not be necessarily executed in the exact order or in the exact way as described herein.

In another embodiment, a headgear device has a cover and a wire, the wire being connected to the player, and the wire being in a serpentine disposition when the cover is not in a stretched position.

More specifically, the present disclosure of a preferred embodiment is a swim cap, the swim cap having a player, wires, earphones, and a cover. The wires have a first wire and a second wire. The earphones have a first earphone and a second earphone. In this embodiment, the cover includes a first layer and a second layer.

The cover is made of elastic or like material that can comfortably stretch a certain amount without losing functionality, such as a rubber-like compound, a stretchable cloth material, etc.

The wires are preferably in a serpentine disposition when the swim cap is in a non-stretched position. This serpentine disposition of the wires allows a swim cap to be stretched without compromising the functionality of the wires, or negatively affecting either how the wires attach to the player, or how the earphones reach to the user's ears.

In this embodiment, the opening is disposed within the first layer, and when the player is placed within the opening, the swim cap will thus secure the player. Alternatively, the opening may expose a pouch that will secure the player while it is inside the opening. Also, the cover may include a single layer, with the wires being disposed and molded within the cover. Or, the opening may be disposed inside the swim cap. The wires may be embedded within an elastic conduit within the cover.

The cap may be a headband or head cover used for any activity, athletic or otherwise, including, for exemplary purposes only and without limitation, a cold-weather hat for skiing or a headband.

In use, a user obtains a swim cap, and then secures the player to the swim cap and attached to a headphone plug 120. The player is started, and optionally secured inside the swim cap. The swim cap is then placed on the user's head, and the earphones are placed in the user's ears.

The player may be any device that can supply audio to earphones, include, for exemplary purposes only and without limitation, an iPod®, an MP3 player, a radio, or any music player with or without internal memory.

In another embodiment, an insert for a headgear device, the insert comprises a layer with an embedded wire being in a serpentine disposition when the layer is not in a stretched position, wherein the wire may include headphones. The insert may be affixed to an existing swim cap, such as, by ultrasonic weld or to glue the insert into the swim cap.

In another embodiment, a head gear audio system, wherein the head gear audio system includes a cord, the cord having a first cord end and a second cord end, an audio plug electrically connected to one end of a third wire, a y-junction electrically connected to an other end of the third wire and the y-junction electrically connected to one end of a first wire and one end of a second wire, a pair of earphones, the pair of earphones having a first earphone electrically connected to an other end of the first wire and a second earphone electrically connected to an other end of the second wire, wherein each of the first wire and the second wire are configured having a first coiled wire section positioned between the y-junction and the first earphone and a second coiled wire section positioned between the y-junction and the second earphone, and wherein the first cord end is positioned therethrough the first coiled wire section and the second cord end is positioned therethrough the second coiled wire section.

In another embodiment, a method of using a head gear audio system, the method comprising the step of obtaining a cord, the cord having a first cord end and a second cord end, the cord having a tensioner, the tensioner having the first cord end and the second cord end inserted therethrough the tensioner, obtaining an audio plug electrically connected to one end of a third wire, a y-junction electrically connected to an other end of the third wire and the y-junction electrically connected to one end of a first wire and one end of a second wire, a pair of earphones, the pair of earphones having a first earphone electrically connected to an other end of the first wire and a second earphone electrically connected to an other end of the second wire, wherein each of the first wire and the second wire are configured having a first coiled wire section positioned between the y-junction and the first earphone and a second coiled wire section positioned between the y-junction and the second earphone.

A feature of the head gear audio system is its ability to enable a user to swim, run, bike, work or perform other activities with a hands free head gear audio system.

Accordingly, a feature of the swim cap with headphones device is its ability to be easy to use.

Another feature of the swim cap with headphones device is its ability to be used by different people with different size heads without compromising functionality in any way.

Yet another feature of the swim cap with headphones device is its ability to function for extended periods of time.

Yet another feature of the swim cap with headphones device is its ability to be easy to manufacture.

Yet another feature of the swim cap with headphones device is its ability to be stretched without negatively affecting the wires, or the wires' connections or connectivity.

These and other features of the head gear audio system will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present head gear audio system will be better understood by reading the Detailed Description with reference to the accompanying drawings, which are not necessarily drawn to scale, and in which like reference numerals denote similar structure and refer to like elements throughout, and in which:

FIG. 6.1 is a perspective view of another exemplary embodiment, shown on a user's head;

FIG. 6.2 is a perspective view of another exemplary embodiment, shown as an insert for a swim cap;

FIG. 9A is a close-up perspective view of the embodiment from FIG. 8 showing the groove of the swim cap;

FIGS. 9B1 and 9B2 is a close-up perspective view of the embodiment from FIG. 8 showing the groove of the swim cap

Figure 1:
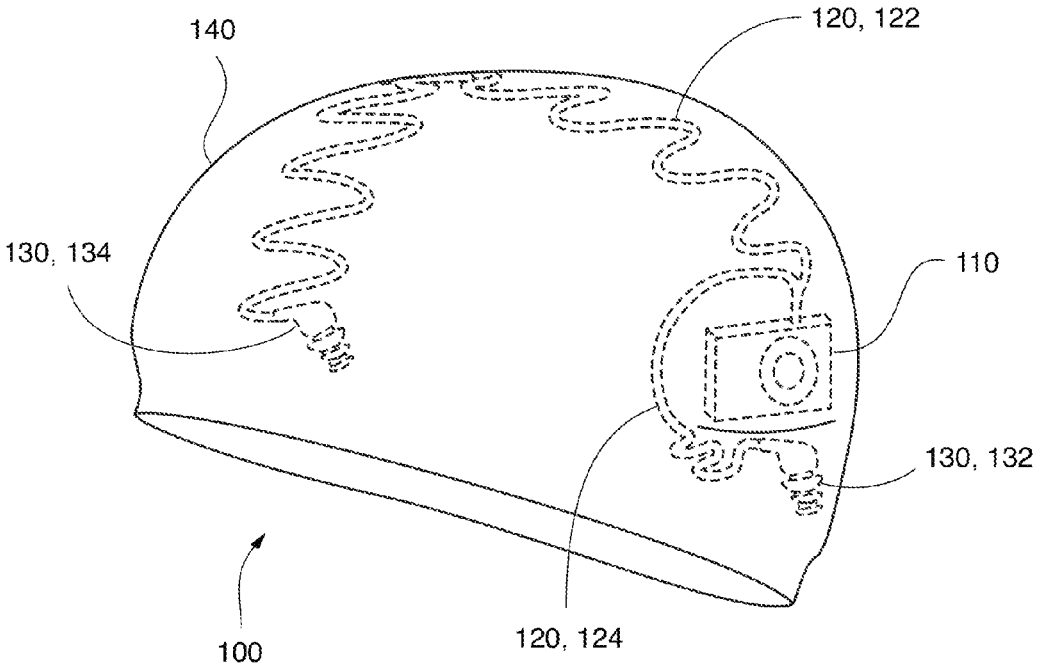
FIG. 1 is a perspective view of an exemplary embodiment.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-18, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-12 by way of example, and not limitation, therein is illustrated an example embodiment swim cap 100, wherein swim cap 100 comprises player 110, wires 120, earphones 130, and cover 140. Wires 120 comprise first wire 122 and second wire 124, each wire 120 having a first wire end and a second wire end. Earphones 130 comprise first earphone 132 and second earphone 134. It is contemplated herein that first earphone 132 and second earphone 134 and player 110 may include water proof earphones and player. In this embodiment, cover 140 comprises a single layer, cover 140.

In this embodiment, cover 140 comprises an elastic material that can comfortably stretch a certain amount without losing functionality, such as, for exemplary purposes only and without limitation, a rubber-like compound, a stretchable cloth material, etc.

Figure 2:
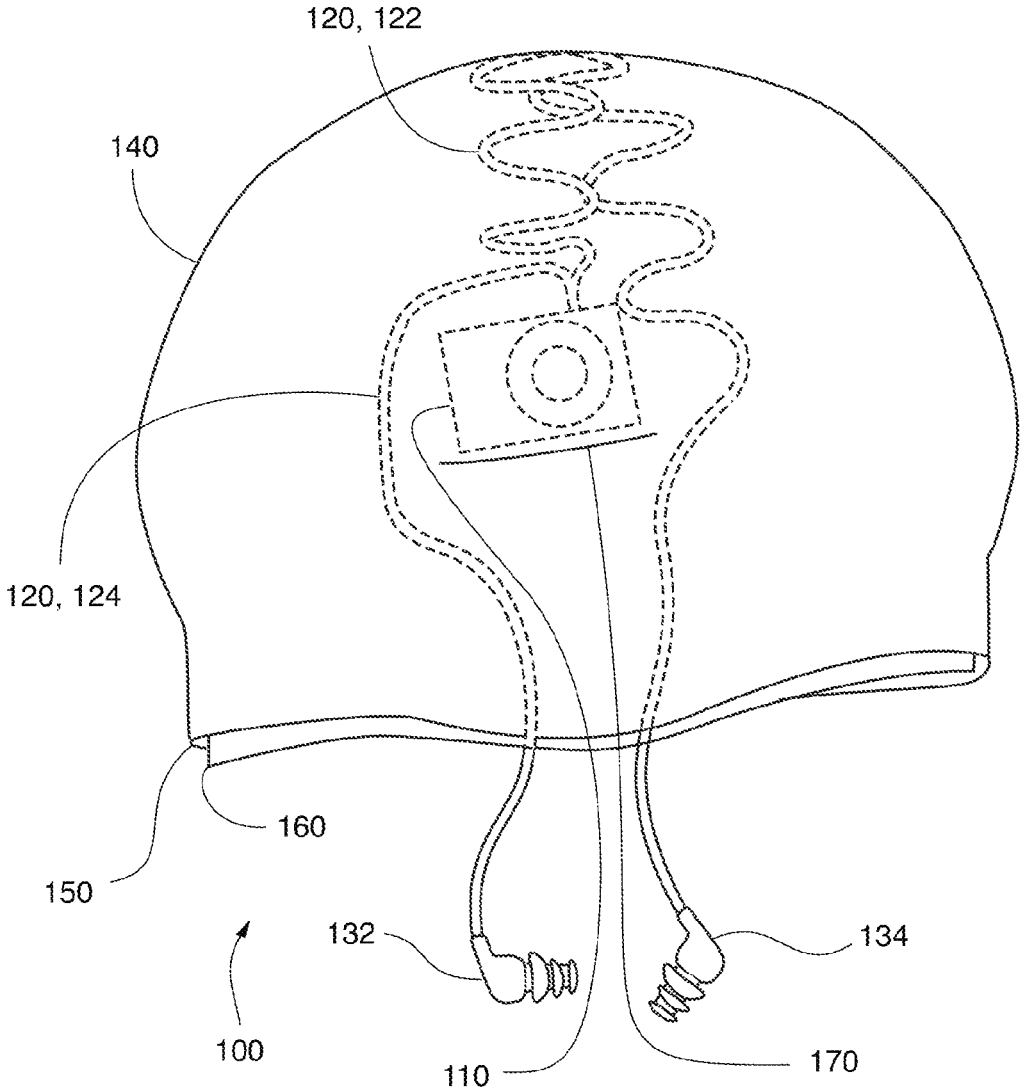
FIG. 2 is a perspective view of another exemplary embodiment, with the earphones extended out of the swim cap.
Figure 3:
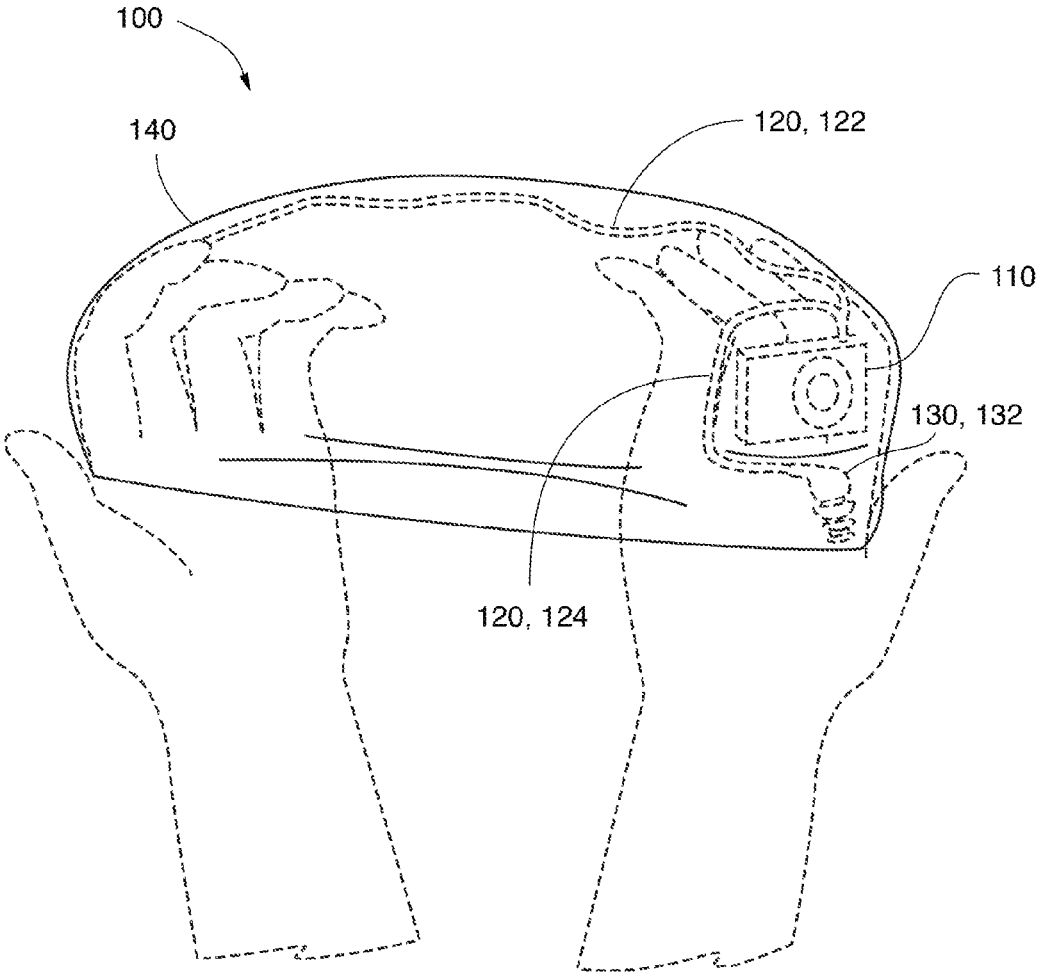
FIG. 3 is a perspective view of the embodiment of FIG. 1, wherein the swim cap and embodiment is being stretched.

Turning now to FIG. 2, illustrated therein is another embodiment of swim cap 100. Once again, swim cap 100 comprises player 110, wires 120, earphones 130, and cover 140, wherein cover 140 comprises first layer 150, second layer 160, and opening 170. In this embodiment, wires 120 are disposed between first layer 150 and second layer 160, wherein wires 120 are in a serpentine disposition when swim cap 100 is a non-stretched position (best shown FIGS. 1, 2, 8 and 9; swim cap 100 in a stretched position is best shown in FIG. 3). This serpentine disposition of wires 120 allows swim cap 100 to be stretched without compromising the functionality of wires 120, or negatively affecting either how wires 120 attach to player 110, or how earphones 130 reach to user's U ears.

In this embodiment, opening 170 is disposed within first layer 150, and placing player 110 within opening 170 will thus secure player 110 by virtue of swim cap 100. Alternatively, opening 170 may expose a pouch that will secure player 110 while inside opening 170. However, it is contemplated herein that cover 140 may comprise a single layer, wherein wires 120 are disposed and molded within cover 140, as shown in FIG. 1. It is further contemplated that opening 170 is disposed inside swim cap 100 (not shown), wherein player 110 would need to be accessed before swim cap 100 is placed on user's U head, or alternatively wherein user U could attempt to manipulate player 110 through cover 140 while swim cap 100 is on user's U head. It is further contemplated herein that wires 120 are embedded within an elastic conduit within cover 140 or imbedded therein during molding.

It is also further contemplated that swim cap 100 may be a headband or head cover used for any activity (best shown in FIG. 6), athletic or otherwise, including, for exemplary purposes only and without limitation, a cold-weather hat for skiing or a headband.

Turning now to FIG. 3, illustrated therein is an exemplary embodiment of swim cap 100, wherein swim cap 100 is in a stretched position. In this embodiment, swim cap 100 again comprises player 110, wires 120, earphones 130, and cover 140. Because swim cap 100 is in a stretched position, wires 120 are no longer in a serpentine disposition. In the illustration shown, wires 120 are mostly, but not completely, straightened out when user inserts hands inside swim cap 100 and separates user's hands. However, it is contemplated herein that the maximum stretch of swim cap 100 may only partially straighten wires 120. It is further contemplated herein that the maximum stretch of swim cap 100 may completely straighten wires 120.

Figure 4:
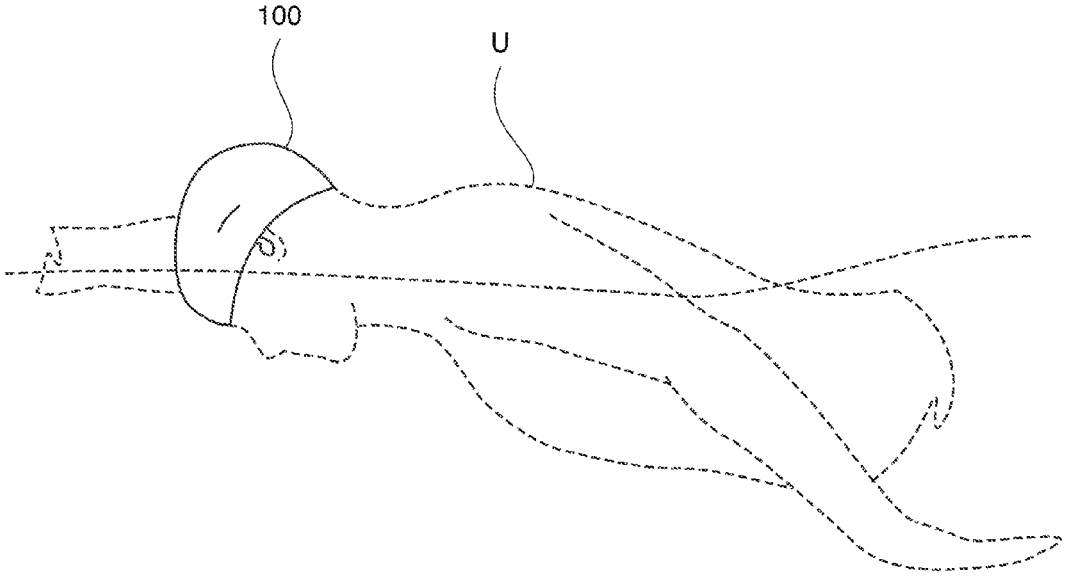
FIG. 4 is a perspective view of the embodiment of FIG. 1, shown in use.
Figure 5:
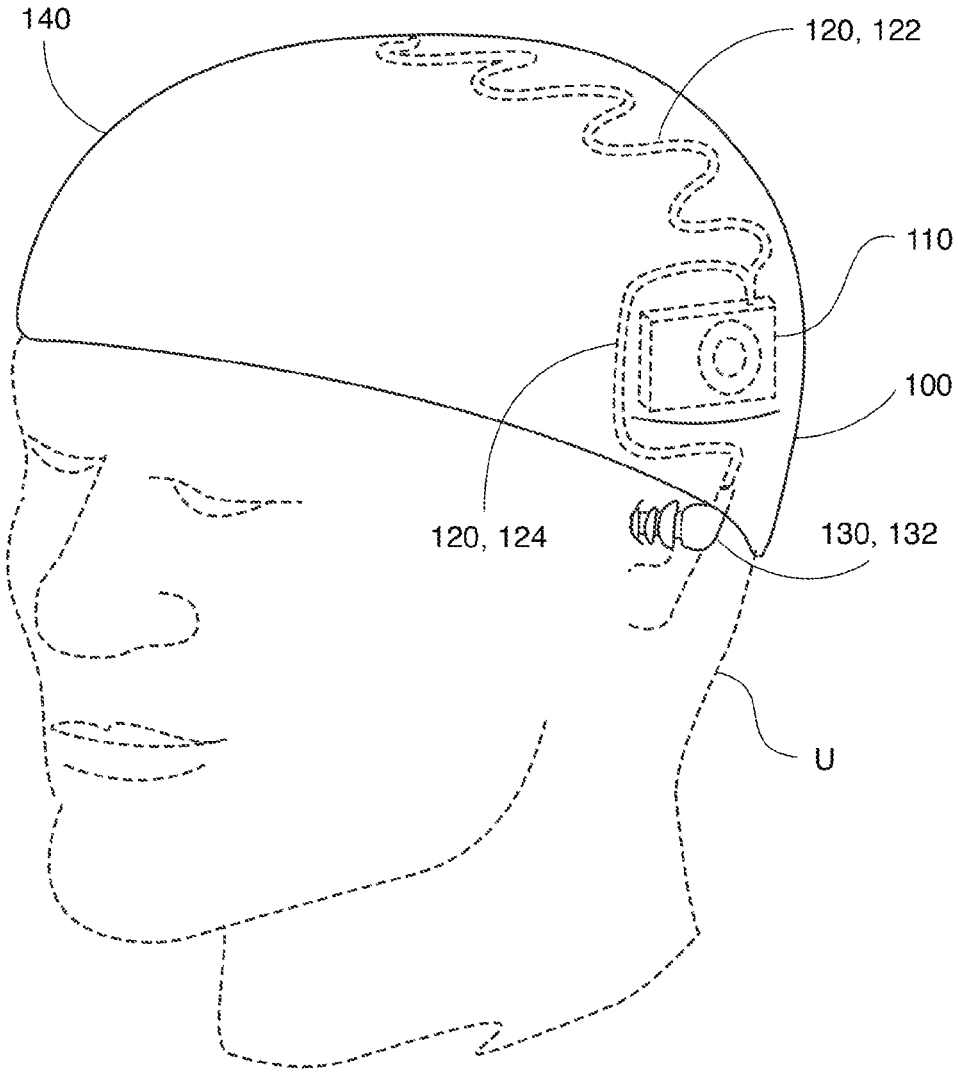
FIG. 5 is a perspective view of the embodiment of FIG. 1, shown on a user's head.

Turning now to FIGS. 4 and 5, illustrated therein is an exemplary embodiment of swim cap 100, wherein swim cap 100 is being utilized by user U. In the illustration shown, swim cap 100 is disposed on user's U head, wherein swim cap 100 only partially covers user's U ears. Earphones 130 extend from swim cap 100 and are placed in user's U ears. However, it is contemplated herein that swim cap 100 may be disposed such that swim cap 100 does not cover user's U ears. It is further, and alternatively, contemplated herein, that swim cap 100 may fully and/or mostly cover user's U ears, in which case earphones 130 would need to be retained or curved back under swim cap 100 to reach user's U ears.

Turning now to FIGS. 6.2, illustrated therein is exemplary embodiments of swim cap insert 100.1 wherein swim cap insert 100.1 comprises wires 120, earphones 130, and strip 190. Wires 120 comprise first wire 122, second wire 124, and third wire with headphone plug 126. Earphones 130 comprise first earphone 132 and second earphone 134. It is contemplated herein that first earphone 132 and second earphone 134 may include water proof earphones. It is further contemplated herein that first earphone 132 and second earphone 134 and headphone plug 127 extend beyond edge 191.

In this embodiment, a band, ribbon or layer, such as strip 190 comprises a single strip or one or more strips, such as, first strip 192, second strip 194, and third strip 196 made of an elastic or bendable material that can comfortably stretch or bend a certain amount without losing functionality, such as, for exemplary purposes only and without limitation, a silicone or rubber-like compound, or a stretchable cloth material, etc. It is contemplated herein that strip 190 may be formed in any configuration capable of integration with to any swim cap or head band or the like. It is further contemplated herein that strip 190 may be positioned within or on the exterior of any swim cap or head band or the like.

In this embodiment, wires 120 may be imbedded in strip 190 or disposed within groove 180 of strip 190, wherein wires 120 are in a serpentine disposition when strip 190 is a non-stretched position (best shown FIGS. 1, 2, 8 and 9; strip 190 in a stretched position is best shown in FIG. 3). Preferably strip 190 of swim cap insert 100.1 is configured as an insert to be affixed, such as by ultrasonic weld or glue, to any swim cap to form swim cap 100. The serpentine disposition of wires 120 in strip 190 of swim cap insert 100.1 enables swim cap 100 to be stretched without compromising the functionality of wires 120, or negatively affecting either how wires 120 attach to player 110, or how earphones 130 reach to user's U ears. It is contemplated herein that swim cap insert 100.1 may be utilized as a removeable insert therein any existing swim cap or may be affixed thereto any existing swim cap, enabling use with one or more existing swim caps to be configured with swim cap insert 100.1 as swim cap 100 or swim cap insert 100.1 may be transferable from one swim cap to another to form swim cap 100.

Figure 7:
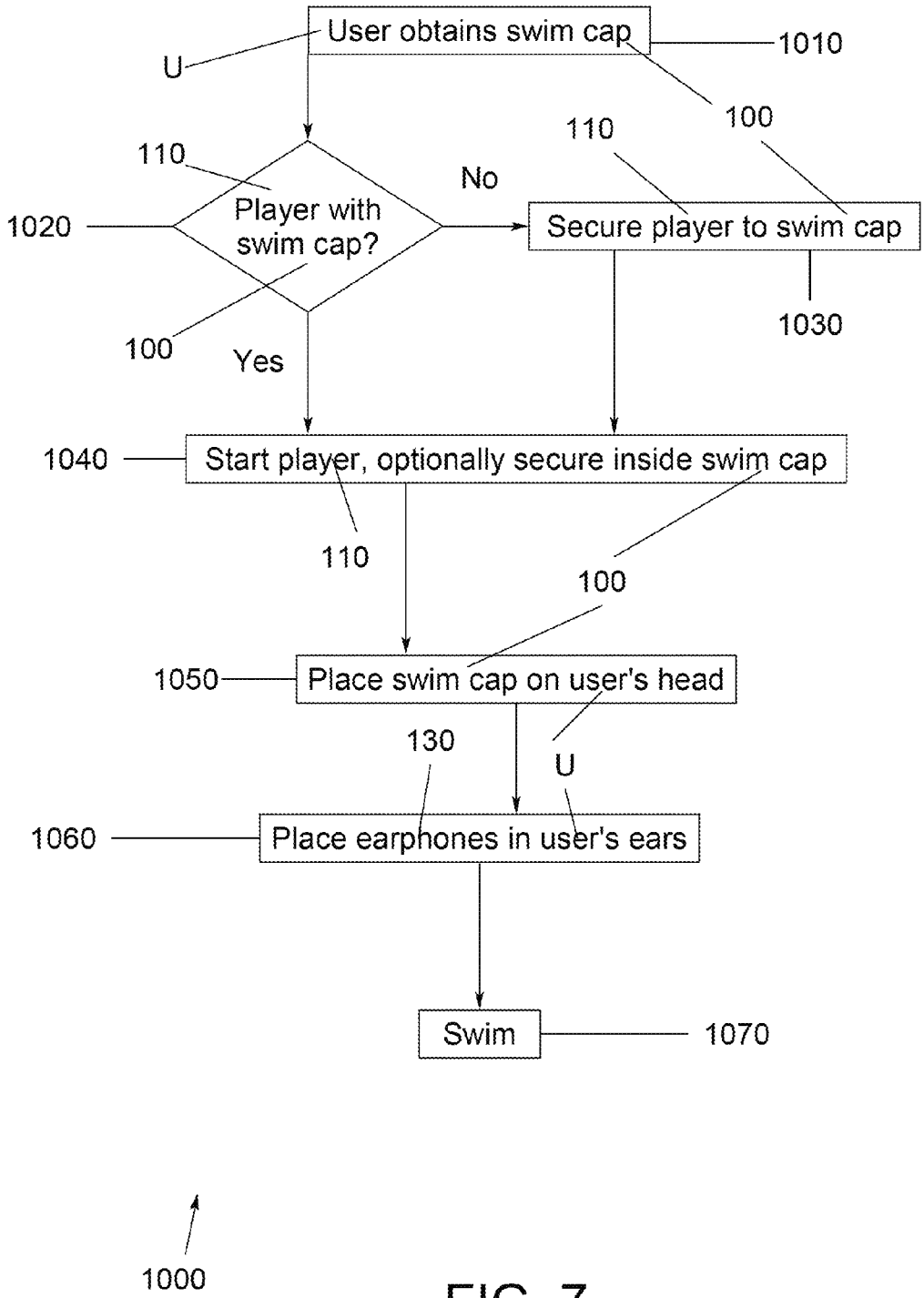
FIG. 7 is a flow chart depicting an exemplary use of an embodiment.
Figure 8:
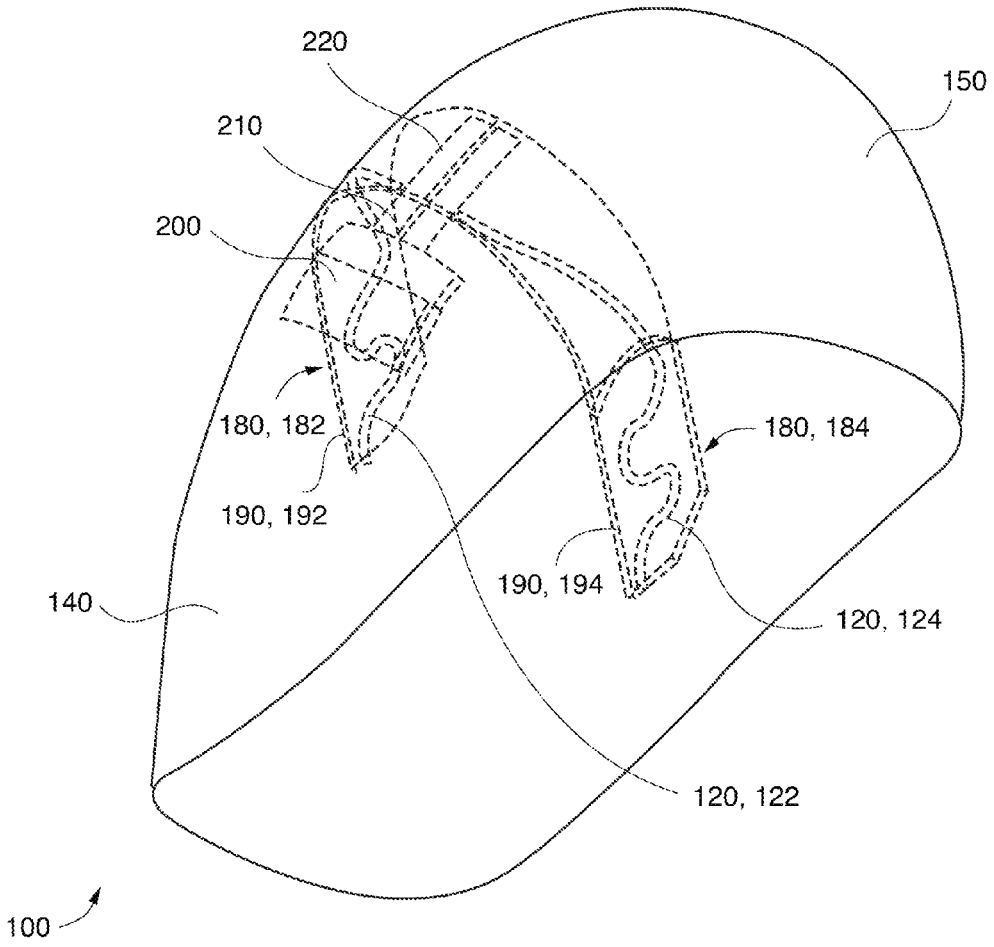
FIG. 8 is a perspective view of another exemplary embodiment of the swim cap with a groove for the earphone wires.

Turning now to FIG. 7, method of using swim cap with headphones 1000 starts with user U obtaining swim cap 100 via step 1010. Via step 1020, if player 110 is with swim cap 100, then method 1000 proceeds to step 1040, otherwise method 1000 proceeds to step 1030. Via step 1030, player 110 is secured to swim cap 100. Via step 1040, player 110 is started, and optionally secured inside swim cap 100. Via step 1050, swim cap 100 is stretched and placed on user's U head, and via step 1060 earphones are placed in user's U ears. Finally, via step 1070, user U starts swimming.

Referring now to FIGS. 8-11 by way of example, and not limitation, therein is illustrated an example embodiment swim cap 100, wherein swim cap 100 comprises groove 180 to accommodate player 110, wires 120, earphones 130, and cover 140. Wires 120 may comprise first wire 122 and second wire 124. Earphones 130 may comprise first earphone 132 and second earphone 134. It is contemplated herein that first earphone 132 and second earphone 134 and player 110 may include water proof earphones and player.

In this embodiment, cover 140 comprises an elastic material that can comfortably stretch a certain amount without losing functionality, such as, for exemplary purposes only and without limitation, a rubber-like compound, a stretchable cloth material, etc.

Figure 10:
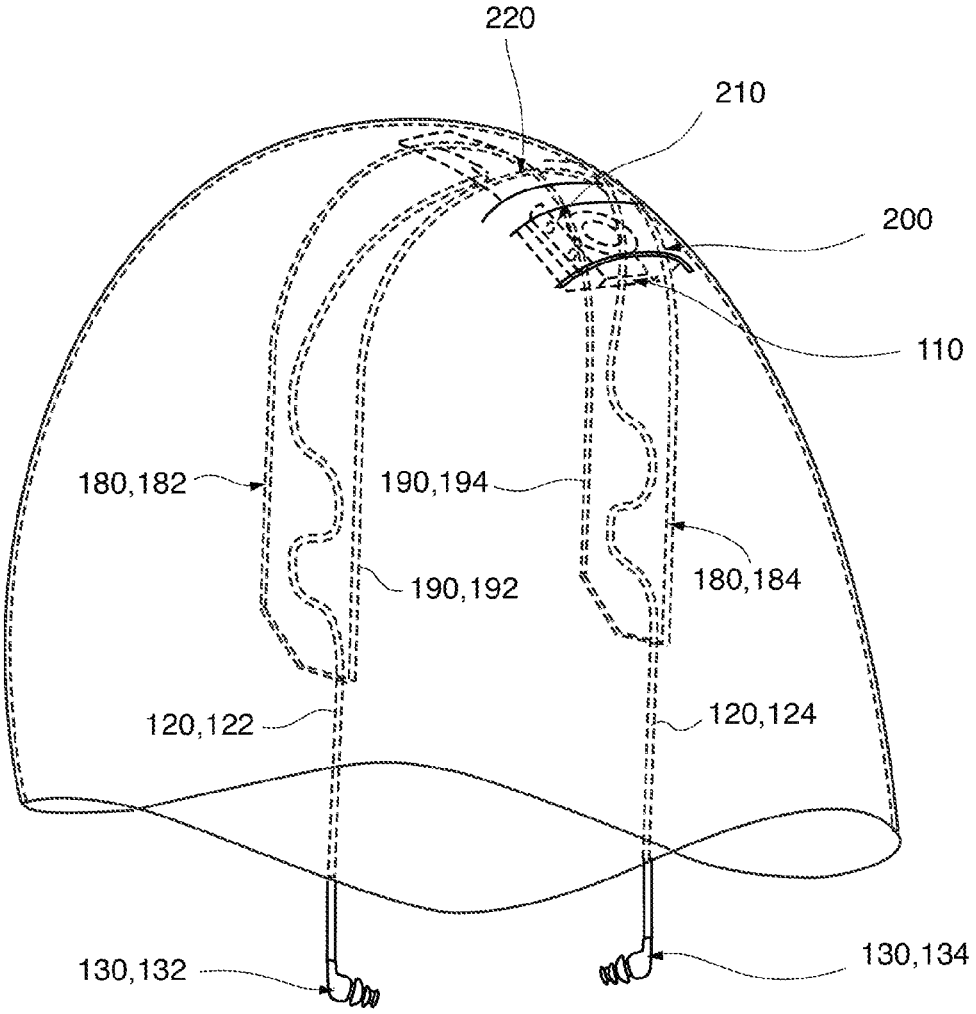
FIG. 10 is a perspective view of another exemplary embodiment of the swim cap with a groove for the earphone wires, with the earphones extended out of the swim cap.
Figure 11:
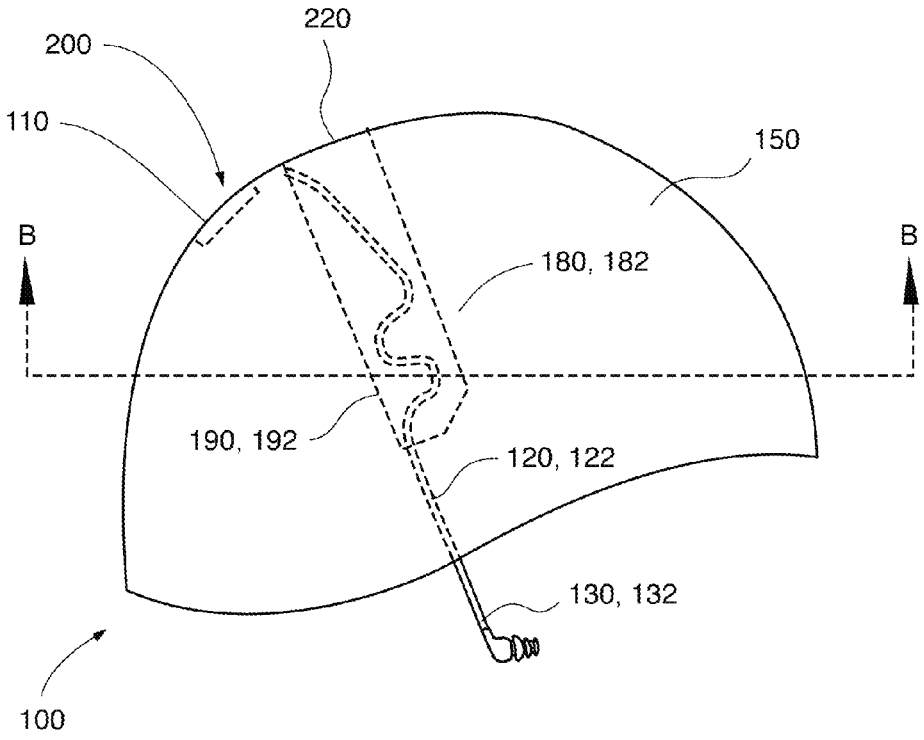
FIG. 11 is a cross sectional side view of the embodiment from FIG. 8.

Turning now to FIGS. 9-11, illustrated therein is further embodiments of swim cap 100. In one embodiment, swim cap 100 may generally comprise cover 140 with a groove 180. The groove 180 may be adapted to accommodate a wire in a serpentine disposition when cover 140 is not in a stretched position wherein groove 180 is preferably formed in a serpentine configuration therein cover 140. In one embodiment, as best shown in FIGS. 9B1 and 9B2, when cover 140 is relaxed, groove 180 may have an overhang lip 186, and when cover 140 is bent, overhang lip 186 may be reduced thereby providing groove opening 188 to access groove 180. This feature of swim cap 100 may allow wire 120 to be easily inserted into groove 180 in a serpentine disposition by merely bending swim cap 100 and inserting the wires 120 into groove 180. Swim cap 100 may also include a player pocket 200 adapted for storing player 110.

In another embodiment, as shown in FIG. 10, swim cap 100 may comprise player 110, wires 120, earphones 130, and cover 140 with groove 180. Cover 140 comprises first layer 150 and/or strip 190, player pocket 200, and wire split pocket 220. In this embodiment, wires 120 are disposed within groove 180 therein first layer 150 and/or strip 190, wherein wires 120 and groove 180 are in a serpentine disposition when swim cap 100 is a non-stretched position (best shown FIGS. 1, 2, 8 and 9; swim cap 100 in a stretched position is best shown in FIG. 3). This serpentine disposition of wires 120 positioned therein groove 180 allows swim cap 100 to be stretched without compromising the functionality of wires 120, or negatively affecting either how wires 120 attach to player 110, or how earphones 130 reach to user's U ears. In one embodiment, the strip 190 may be disposed on the interior of first layer 150, thereby forming groove 180 on the interior of first layer 150. In an alternative embodiment, strip 190 may be disposed on the exterior of first layer 150, thereby forming groove 180 on the exterior of first layer 150.

In one embodiment, groove 180 may comprise a first groove 182 for first wire 122 and a second groove 184 for second wire 124. In this embodiment, strip 190 may comprise a first strip 192 for creating first groove 182 and a second strip 194 for creating second groove 184.

In this embodiment, player pocket 200 may be disposed within first layer 150, and placing player 110 within player pocket 200 will thus secure player 110 by virtue of swim cap 100. Alternatively, player pocket 200 may expose a pouch that will secure player 110 while inside player pocket 200. However, it is contemplated herein that cover 140 may comprise a single layer, wherein wires 120 are disposed and molded within a groove 180 inside the single layer of cover 140. It is further contemplated that player pocket 200 is disposed inside swim cap 100 (not shown), wherein player 110 would need to be accessed before swim cap 100 is placed on user's U head, or alternatively wherein user U could attempt to manipulate player 110 through cover 140 while swim cap 100 is on user's U head. It is further contemplated herein that wires 120 are embedded within an elastic conduit within groove 180 or imbedded therein during molding of cover 140.

In one embodiment, a wire split pocket 220 may be provided between player pocket 200 and groove 180 or first and second grooves 182 and 184, respectively. Wire split pocket 220 may be for housing wire 120 where it splits off into the first and second wires before the first and second grooves 182 and 184, respectively.

Figure 12:
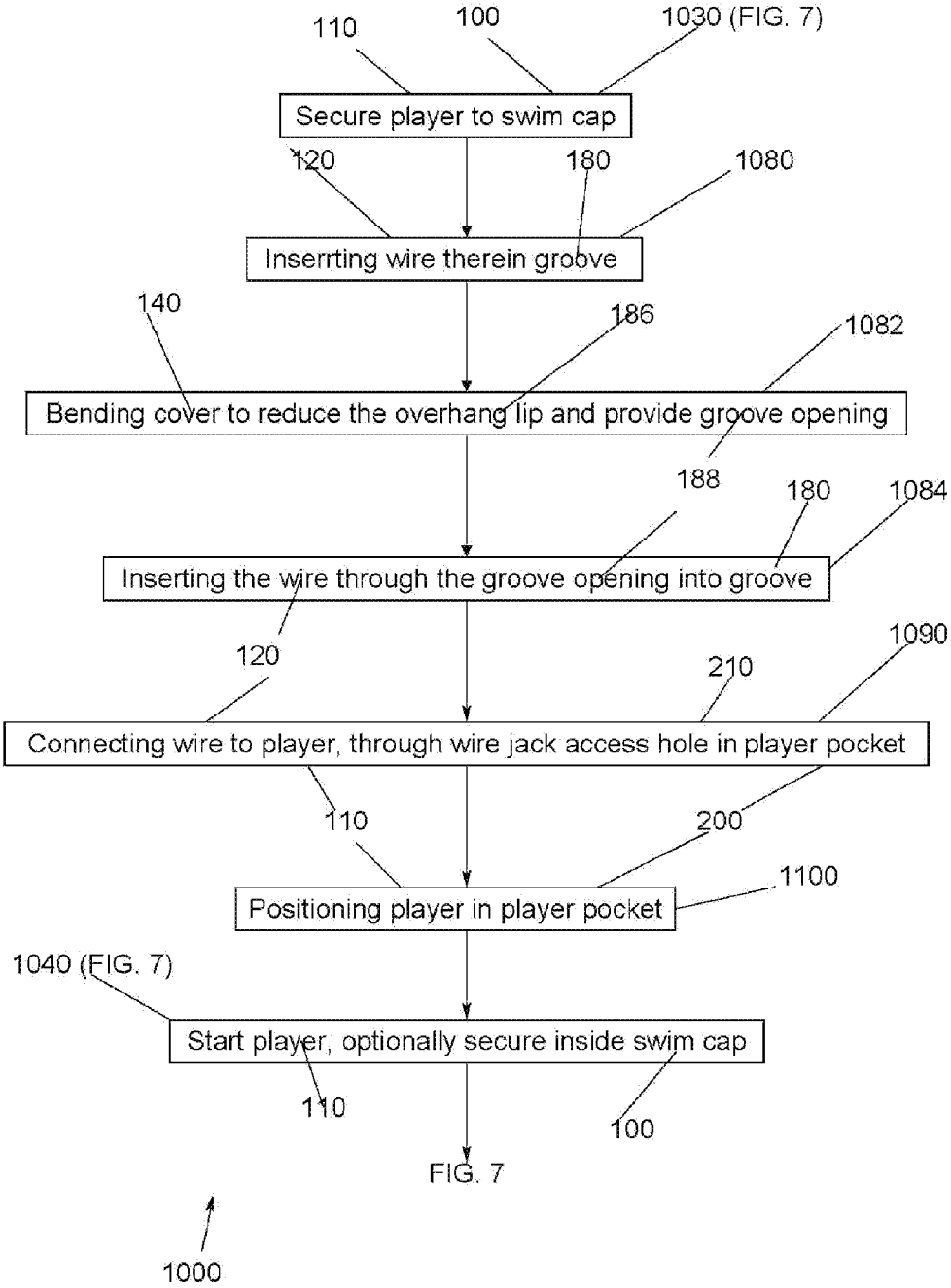
FIG. 12 is a flow chart depicting an exemplary use of another embodiment.

Turning now to FIG. 12, method of using swim cap with headphones 1000 starts with user U obtaining swim cap 100 (swim goggle audio component 300) via step 1010. Via step 1020, if player 110 is with swim cap 100, then method 1000 proceeds to step 1040, otherwise method 1000 proceeds to step 1030. Via step 1030, player 110 (swim goggle audio component 300) is secured to swim cap 100 (swim goggles 400). Via step 1040, player 110 is started, and optionally secured inside swim cap 100. To secure the player 110 (swim goggle audio component 300) to swim cap 100 (swim goggles 400), step 1030 may include a step 1080 of inserting wire 120 (goggle strap 420) through or positioning therein groove 180 (coiled wire 320 of swim goggle audio component 300) in a serpentine disposition. Step 1080 may include a step 1082 of bending cover 140 to reduce the overhang lip 186 and provide groove opening 188. Once the groove opening 188 is large enough, a step 1084 of inserting the wire 120 through the groove opening 188 into groove 180 may be accomplished. In addition, step 1030 may include a step 1090 of connecting wire 120 to player 110, like through wire jack access hole 210 in player pocket 200. Also, step 1030 may include a step 1100 of positioning player 110 in player pocket 200 (goggle strap 420). Via step 1050, swim cap 100 is stretched and placed on user's U head, and via step 1060 earphones 130 may be placed in user's U ears. Finally, via step 1070, user U starts swimming. At any desired time during the process, a step of starting the player 110 may be included. Starting the player 110 may include, audio being played by the earphones 130.

It is contemplated herein that player 110 may comprise any device that can supply audio to earphones, include, for exemplary purposes only and without limitation, an iPod®, any MP3 player, a radio, or any music player with or without internal memory.

Figure 13:
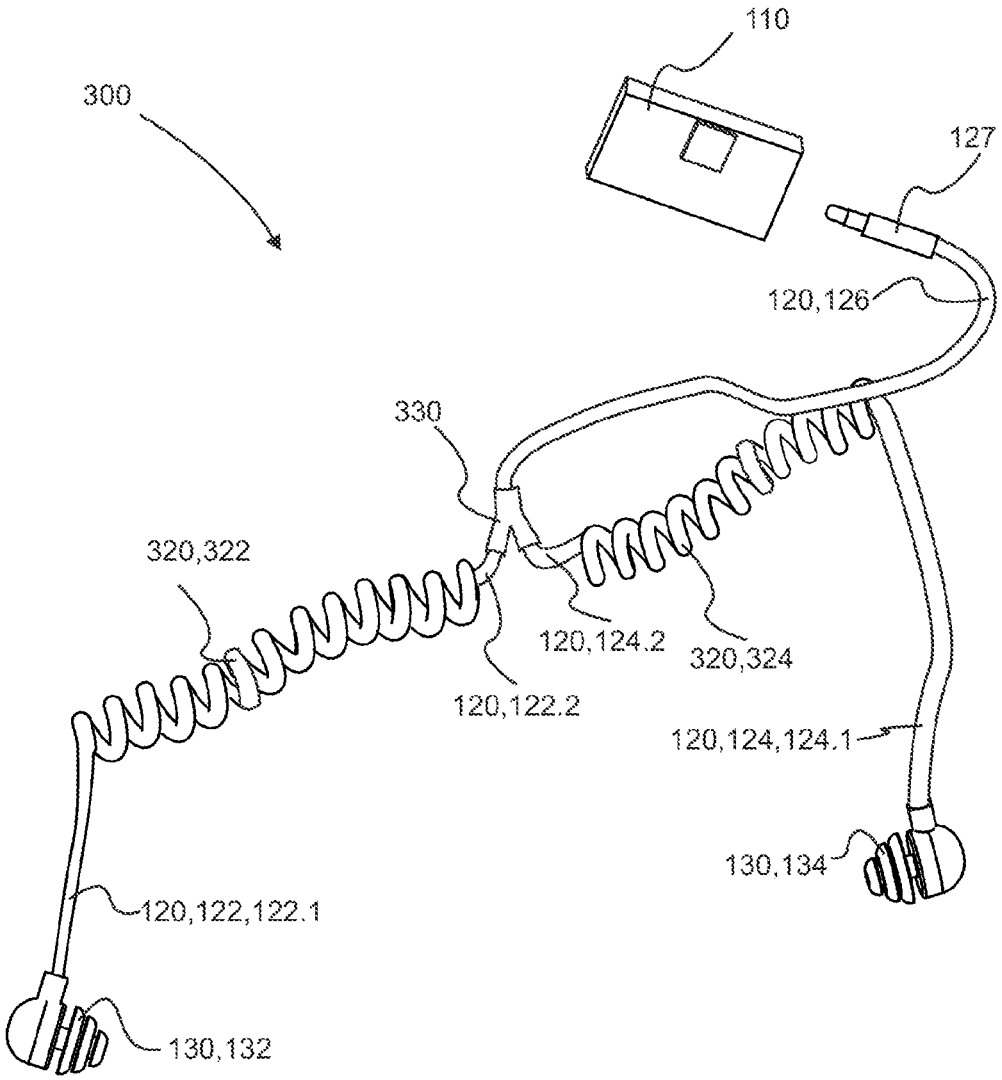
FIG. 13 is a perspective view of another exemplary embodiment, of a swim audio system.

Turning now to FIG. 13, illustrated therein is exemplary embodiment of swim goggle attachment, such as swim goggle audio component 300 wherein swim goggle audio component 300 includes electrically connected wires 120, pair of water proof speakers, headphones, or earbuds, with or without ear hooks, such as earphones 130, and an audio plug, such as headphone plug 127. Wires 120 comprise a pair of single channel insulated conductors, such as left or first wire 122, right or second wire 124, and a dual channel insulated conductor, such as third wire 126, the third wire 126 having headphone plug 127. Earphones 130 comprise first earbud or earphone 132 and second earbud or earphone 134. Wires 120, more specifically left or first wire 122, right or second wire 124, each include a coiled wire section(s), segment, partial or full coiled wire, such as coiled wire 320. Preferably coiled wire 320 includes a first or left coiled wire 322 and a second or right coiled wire 324 positioned between third wire 126 and earphone 132 and second earphone 134, respectively. It is contemplated herein that first earphone 132 and second earphone 134 may include water proof earphones or earbuds. It is further contemplated herein that first earphone 132 and second earphone 134 and headphone plug 126 extend beyond right coiled wire 322 and left coiled wire 324, respectively. It is still further contemplated herein that the junction between third wire 126 and first wire 122 and second wire 124 may include straight split wires, or a y-adapter, such as y-junction 330.

It is still further contemplated herein that first wire 122 includes a first straight section 122.1 between first earbud 132 and first or left coiled wire 322 to extend first wire 122 and position first earbud 132 proximate user's U left ear.

It is still further contemplated herein that second wire 124 includes a second straight section 124.1 between second earbud 132 and second or right coiled wire 324 to extend second wire 124 and position second earbud 134 proximate user's U right ear.

It is still further contemplated herein that first wire 122 includes other end or third straight section 122.2 between first or left coiled wire 322 and y-junction 330.

It is still further contemplated herein that second wire 124 includes other end or fourth straight section 124.2 between second or right coiled wire 324 and y-junction 330.

Figure 14:
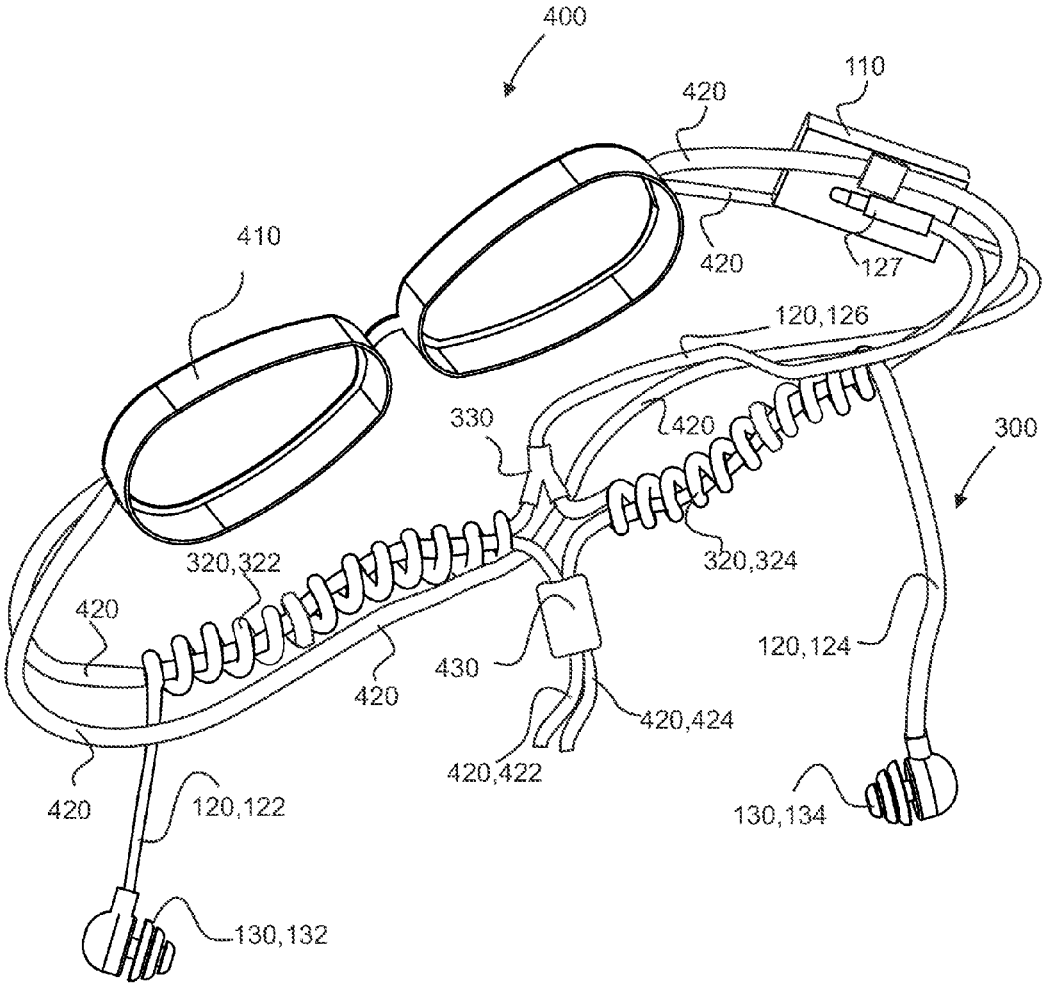
FIG. 14 is a perspective view of the exemplary embodiment swim audio system of FIG. 13 in combination with a strapped goggle.

Turning now to FIG. 14, illustrated therein is exemplary embodiment of swim goggle audio component 300 coiled over or in combination with swim goggles 400. Preferably swim goggles 400 includes goggles 410, goggle strap 420, and quick connect 430. It is contemplated herein that goggle strap 420 may include other flexible strap configurations or material choices, such as latex straps, bungee cord and the like. It is contemplated herein that quick connect 430 may include other tensioners, friction adjustment, fasteners, and like length adjustment devices. It is further contemplated herein that quick connect 430 is configured to enable length adjustment of goggle strap 420 (including length adjustment of first or left goggle strap end 422 of goggle strap 420 and second or right goggle strap end 424)

Figure 15:
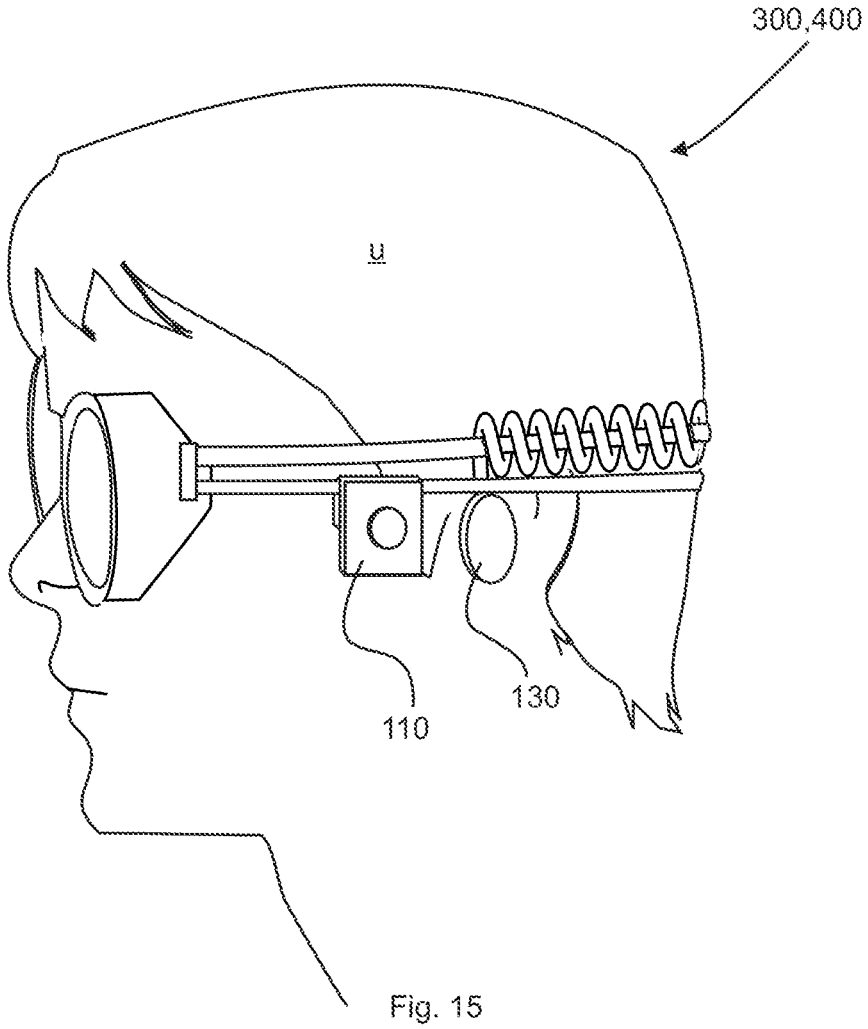
FIG. 15 is a side view of a user wearing the combination swim audio system integrated strapped goggles of FIG. 14.

Turning now to FIG. 14, 15 and FIG. 12, illustrated therein is exemplary embodiment of swim goggle audio component 300 coiled over or in combination with swim goggles 400. In use user U obtaining swim goggle audio component 300 and swim goggles 400 via step 1010. Via step 1030, swim goggle audio component 300 is secured to or coiled around goggle strap 420 of swim goggles 400. To secure swim goggle audio component 300 to swim goggles 400, step 1030 may include a step 1080 of removing or disconnecting quick connect 430 from goggle strap 420 (first or left goggle strap end 422 of goggle strap 420 and second or right goggle strap end 424) and pushing or feeding goggle strap 420 through or positioned therein or therethrough coiled wire 320 of swim goggle audio component 300 or wrapping coiled wire 320 around goggle strap 420. It is contemplated herein that a first or left goggle strap end 422 of goggle strap 420 may be inserted therein or therethrough left coiled wire 322 or wrapped therearound left goggle strap end 422 and a second or right goggle strap end 424 of goggle strap 420 may be inserted therein or therethrough right coiled wire 324 or wrapped therearound right goggle strap end 424. Repositioning or reconnecting quick connect 430 to or adjusting thereon quick connect 430 of goggle strap 420 (first or left goggle strap end 422 of goggle strap 420 and second or right goggle strap end 424). Moreover, quick connect 430 may be utilized to adjust the length of first or left goggle strap end 422 and second or right goggle strap end 424 of goggle strap 420. Preferably player 110 may be attached or removeably affixed to goggle strap 420 of swim goggles 400. Swim goggle audio component 300 in combination with swim goggles 400 may be placed on user's U head, and via step 1060 earphones 130 may be placed in user's U ears. Finally, via step 1070, user U starts swimming. At any desired time during the process, a step of starting the player 110 may be included. Starting the player 110 may include, audio being played by the earphones 130.

Figure 16:
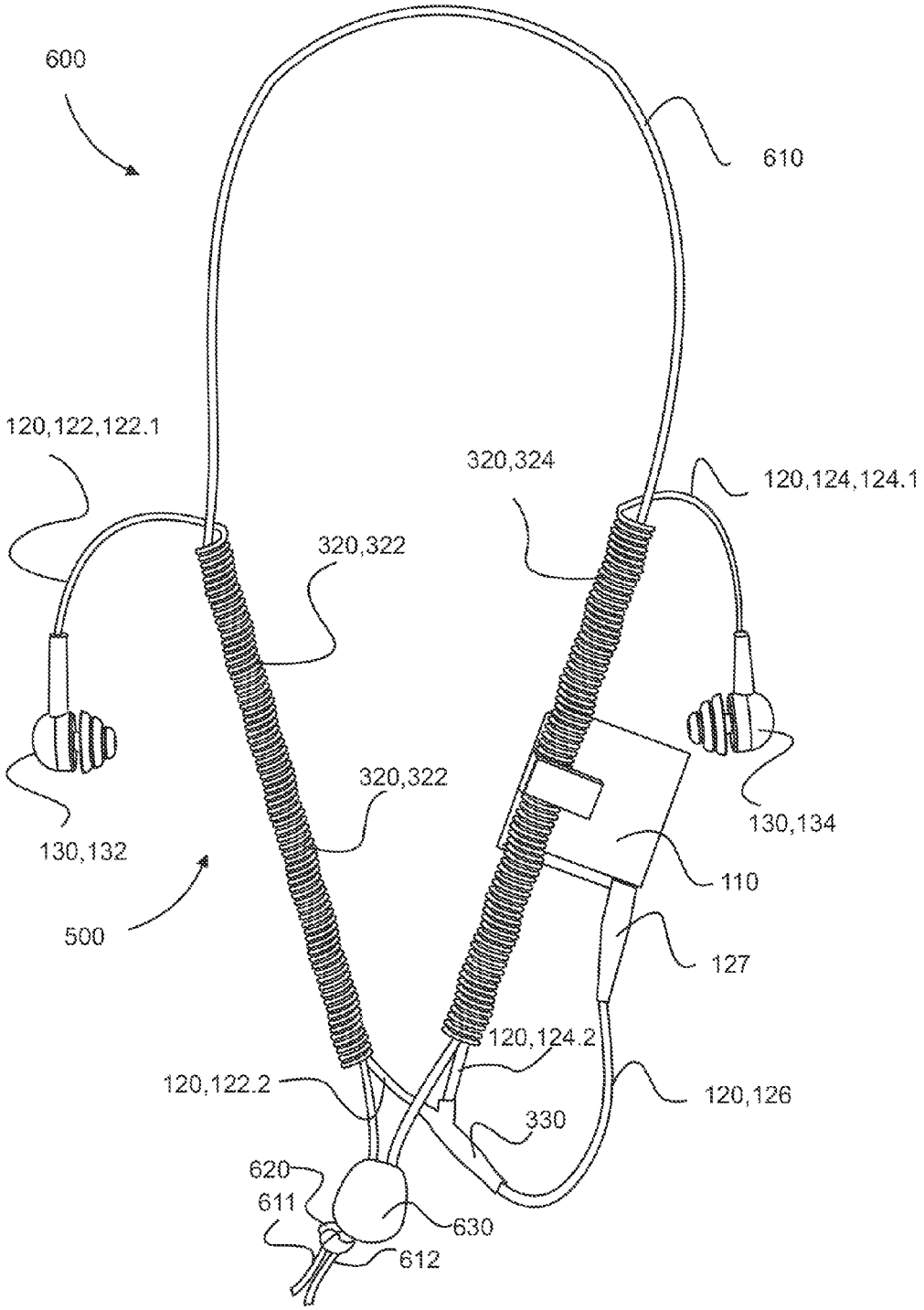
FIG. 16 is a top view of another exemplary embodiment, of a head gear audio system.

Turning now to FIG. 16, illustrated therein is exemplary embodiment of head gear audio system, such as head gear audio system 600 wherein head gear audio system 600 includes coiled wire audio system 500 having electrically connected wires 120, pair of water proof speakers, headphones, or earbuds (or plural is pair of), with or without ear hooks, such as earphones 130, and an audio plug, such as headphone plug 127. Wires 120 (having one end and other end) comprise a pair of single channel, insulated conductors, such as left or first wire 122, right or second wire 124, and a dual channel, insulated conductor, such as third wire 126, the third wire 126 having headphone plug 127. It is contemplated herein that each of wires 120 includes a first or one wire end or one end and a second or other wire end or other end. Earphones 130 comprise first earbud or earphone 132 and second earbud or earphone 134. Wires 120, more specifically left or first wire 122, right or second wire 124, each include a coiled wire section(s), segment, partial or full coiled wire, such as coiled wire 320. Preferably coiled wire 320 includes sections, such as first or left coiled wire 322 and second or right coiled wire 324 positioned between third wire 126 and earphone 132 and second earphone 134, respectively. It is contemplated herein that first earphone 132 and second earphone 134 may include water proof earphones or earbuds. It is further contemplated herein that first earphone 132 and second earphone 134 and headphone plug 126 extend beyond first or left coiled wire 322 and second or right coiled wire 324, respectively. It is still further contemplated herein that the junction between third wire 126 and first wire 122 and second wire 124 may include straight split wires, or a y-adapter, such as y-junction 330.

It is still further contemplated herein that first wire 122 includes a first straight section 122.1 between first earbud 132 and first or left coiled wire 322 to extend first wire 122 and position first earbud 132 proximate user's U left ear LE.

It is still further contemplated herein that second wire 124 includes a second straight section 124.1 between second earbud 132 and second or right coiled wire 324 to extend second wire 124 and position second earbud 134 proximate user's U right ear RE.

It is still further contemplated herein that first wire 122 may include other end or third straight section 122.2 between first or left coiled wire 322 and y-junction 330.

It is still further contemplated herein that second wire 124 may include other end or fourth straight section 124.2 between second or right coiled wire 324 and y-junction 330.

Turning again to FIG. 16, illustrated therein is exemplary embodiment of coiled wire audio system 500 coiled over, around, or in combination with, having headband, string, strap, or headgear, such as cord 610 having first cord end 611 and second cord end 612 fed through or inserted therein coiled wire 320. It is contemplated herein that cord 610 may include flexible cord or strap configurations or material choices, such as latex straps, bungee cord, paracord and the like. Preferably first cord end 611 and second cord end 612 of cord 610 may be inserted therein left coiled wire 322 and right coiled wire 324, respectively and then may be inserted therein tensioner 630. It is contemplated herein that tensioner 630 may include other quick connect, friction adjustment, fasteners, and like length adjustment devices. It is further contemplated herein that tensioner 630 may be configured to enable length or circumference adjustment of cord 610 (including length adjustment of first or left cord end 611 and second or right cord end 612). It is further contemplated herein that first cord end 611 and second cord end 612 of cord 610 may be knotted via knot 620 to prevent either left coiled wire 322, right coiled wire 324, or tensioner 630 from slipping off first cord end 611 and second cord end 612 of cord 610. Preferably player 110 may be attached, clipped or removeably affixed to cord 610 or either left coiled wire 322, or right coiled wire 324. It is yet further contemplated herein that tensioner 630 may be adjusted or slid away from knot 620 to enable length or circumference adjustment of cord 610 (including length adjustment of first or left cord end 611 and second or right cord end 612.

Figure 17:
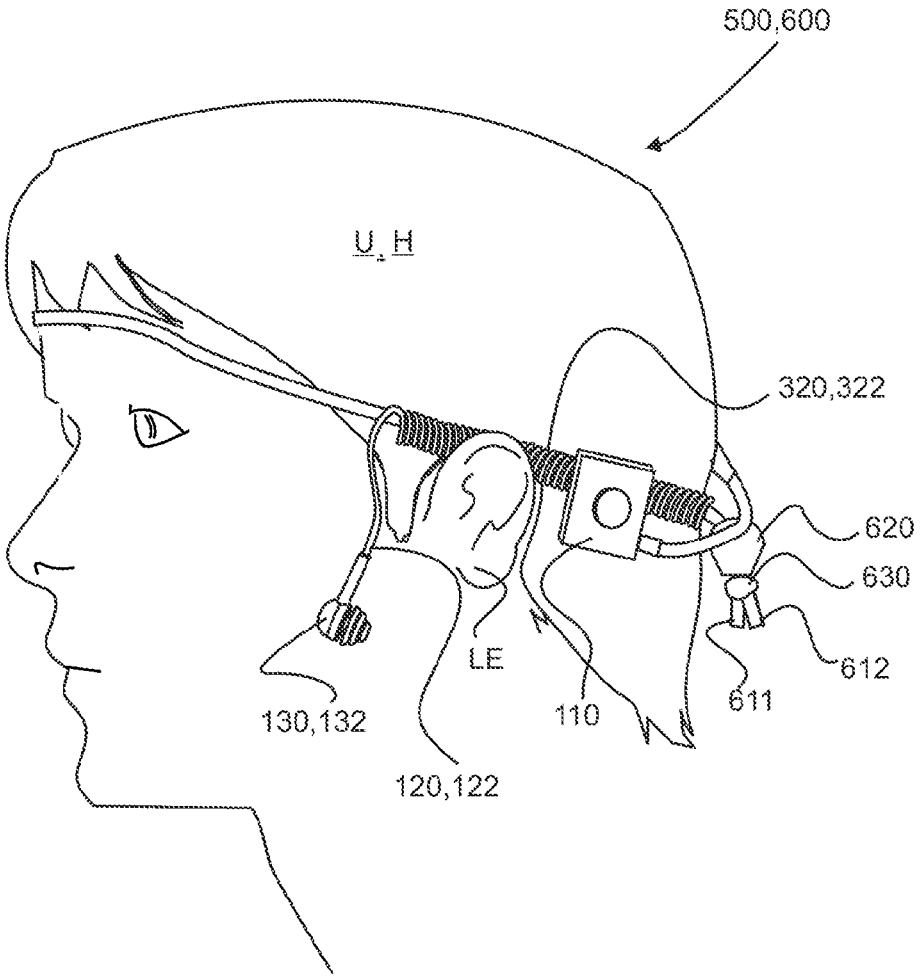
FIG. 17 is a side view of a user wearing the head gear audio system of FIG. 16.
Figure 18:
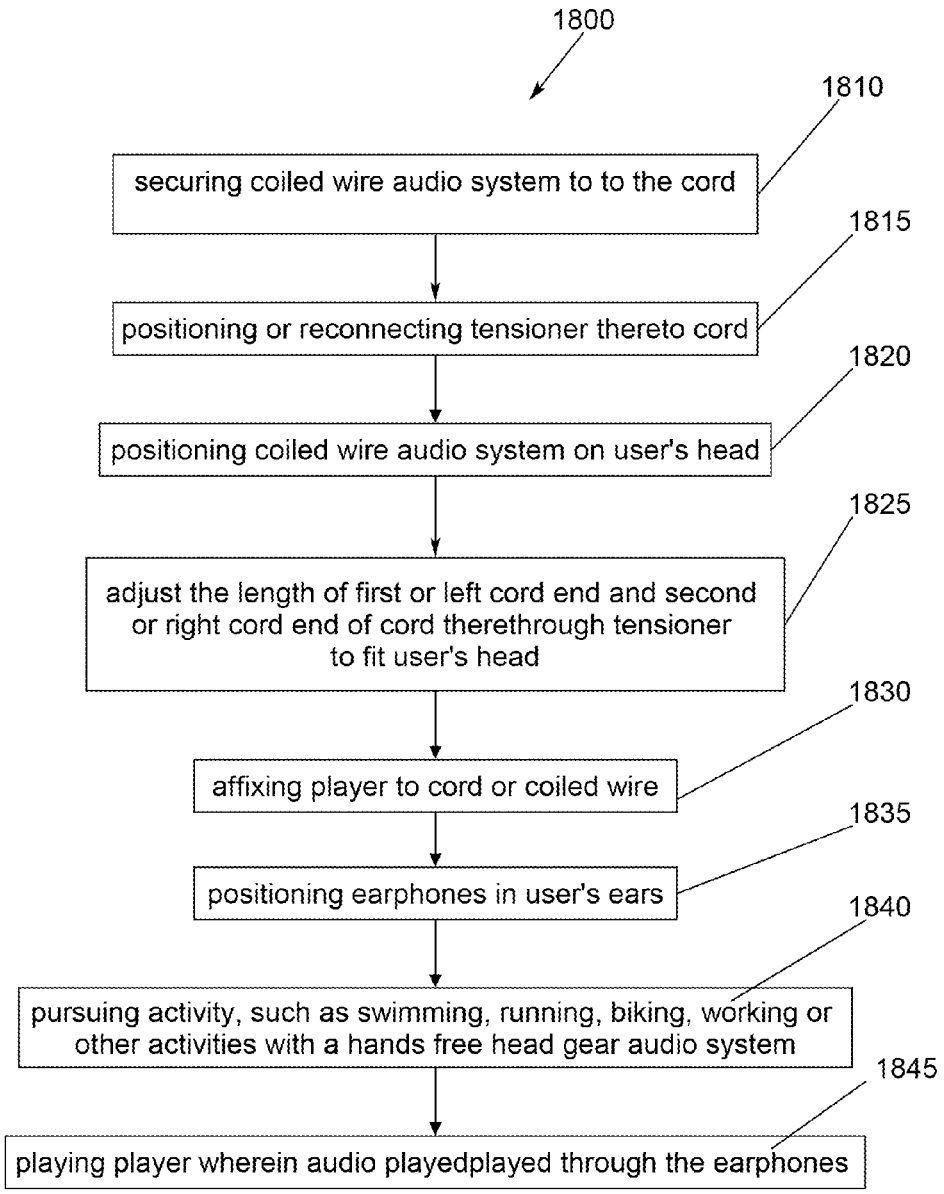
FIG. 18 is a flow chart depicting an exemplary use of another embodiment.

Turning now to FIGS. 16, 17 and 18, illustrated therein in use user U obtaining head gear audio system 600 via step 1800. Via step 1810, securing coiled wire audio system 500 to or coiled around cord 610 or cord 610 may be inserted therein left coiled wire 322, right coiled wire 324. To secure coiled wire audio system 500 to cord 610, may include a step 1810 of removing or disconnecting coiled wire audio system 500 and/or knot 620 and pushing or feeding cord 610 through or positioned therein or therethrough coiled wire 320 of coiled wire audio system 500 or wrapping coiled wire 320 around cord 610. It is contemplated herein that a first or left cord end 611 of cord 610 may be inserted therein or therethrough left coiled wire 322 or wrapped therearound first or left cord end 611 and second or right cord end 612 of cord 610 may be inserted therein or therethrough right coiled wire 324 or wrapped therearound second or right cord end 612. In step 1815 repositioning or reconnecting tensioner 630 to and/or adjusting thereon tensioner 630 to first cord end 611 and second cord end 612 of cord 610 and placing or via step 1820 positioning coiled wire audio system 500 on user's U head H. Moreover, tensioner 630 may be utilized to adjust (adjusting) via step 1825 the length of first or left cord end 611 and second or right cord end 612 of cord 610 therethrough tensioner 630 to fit user's U head H. In step 1830, affixing, or preferably player 110 may be attached or removeably affixed to cord 610 or coiled wire 320. Preferably, head gear audio system 600 may be placed on user's U head, and via step 1835 earphones 130 may be placed in user's U ears RE/LE. Finally, via step 1840, user U may swim, run, bike, work or perform other activities with a hands free head gear audio system 600. At any desired time during the process, a step 1845 of starting the player 110 may be included. Starting the player 110 may include, audio being played through the earphones 130.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A head gear audio system, wherein the head gear audio system comprises:

a flexible cord, said flexible cord having a first cord end and a second cord end;

an audio plug electrically connected to one end of a third wire;

a y-junction electrically connected to an other end of said third wire and said y-junction electrically connected to one end of a first wire and one end of a second wire;

a pair of earphones, said pair of earphones having a first earphone electrically connected to an other end of said first wire and a second earphone electrically connected to an other end of said second wire;

wherein each of said first wire and said second wire are configured having a first coiled wire section positioned between said y-junction and said first earphone with said flexible cord positioned therethrough, and a second coiled wire section positioned between said y-junction and said second earphone with said flexible cord positioned therethrough;

and wherein said first cord end is connected to said second cord end thereby forming the head pear audio system configured to be positioned on a user's head via the flexible cord.

2. The head gear audio system of claim 1, wherein said third wire is a dual channel.

3. The head gear audio system of claim 1, wherein said first wire is a first single channel.

4. The head gear audio system of claim 1, wherein said second wire is a second single channel.

5. The head gear audio system of claim 1, wherein said first wire further comprises a first straight section between said first earphone and said first coiled wire section.

6. The head gear audio system of claim 1, wherein said second wire further comprises a second straight section between said second earphone and said second coiled wire section.

7. The head gear audio system of claim 1, further comprises a player, said player electrically connected to said audio plug.

8. The head gear audio system of claim 1, further comprises a tensioner, said tensioner having said first cord end and said second cord end inserted therethrough said tensioner.

9. The head gear audio system of claim 8, wherein said tensioner is configured to enable length adjustment of said first cord end and said second cord end.

10. The head gear audio system of claim 7, wherein said player is removeably affixed to said first cord end, said second cord end, said first coiled wire section, or said second coiled wire section.

11. A method of using a head gear audio system, the method comprising the step of:

obtaining a flexible cord, said flexible cord having a first cord end and a second cord end, said flexible cord having a tensioner, said tensioner having said first cord end and said second cord end inserted therethrough said tensioner;

obtaining an audio plug electrically connected to one end of a third wire, a y-junction electrically connected to an other end of said third wire and said y-junction electrically connected to one end of a first wire and one end of a second wire, a pair of earphones, said pair of earphones having a first earphone electrically connected to an other end of said first wire and a second earphone electrically connected to an other end of said second wire, wherein said first wire is configured having a first coiled wire section positioned between said y-junction and said first earphone with said flexible cord positioned therethrough, and said second wire is configured having a second coiled wire section positioned between said y-junction and said second earphone with said flexible cord positioned therethrough;

wherein said first cord end is connected to said second cord end thereby forming the head gear audio system configured to be positioned on a user's head via the flexible cord.

12. The method of claim 11, further comprising the step of:

obtaining a player;

connecting said player to said audio plug;

affixing said player to said first cord end, said second cord end, said first coiled wire section, or said second coiled wire section.

13. The method of claim 12, further comprising the step of:

placing said flexible cord on a user's head;

placing said pair of earphones in user's ears; and starting said player, wherein starting said player comprises audio being played by said earphones.

14. The method of claim 13, further comprising the step of adjusting said first cord end and said second cord end therethrough said tensioner to fit said flexible cord to said user's head.

* * * * *